US007362222B1

(12) United States Patent
Holz

(10) Patent No.: US 7,362,222 B1
(45) Date of Patent: Apr. 22, 2008

(54) EYEGLASS LOCATOR

(76) Inventor: Doris Holz, 325 E. 77th St. #1G, New York, NY (US) 10021

( * ) Notice: Subject to any disclaimer, the term of this patent is extended or adjusted under 35 U.S.C. 154(b) by 551 days.

(21) Appl. No.: 10/934,131

(22) Filed: Sep. 4, 2004

Related U.S. Application Data

(60) Provisional application No. 60/499,686, filed on Sep. 3, 2003.

(51) Int. Cl.
*G08B 1/08* (2006.01)

(52) U.S. Cl. ..... 340/539.32; 340/571; 351/158

(58) Field of Classification Search ..... 340/539.32, 340/571; 351/158; 455/347, 350, 351, 344
See application file for complete search history.

(56) References Cited

U.S. PATENT DOCUMENTS

| | | | | |
|---|---|---|---|---|
| 3,853,393 | A * | 12/1974 | Fila et al. | 351/158 |
| 5,159,639 | A * | 10/1992 | Shannon et al. | 381/327 |
| 5,606,743 | A * | 2/1997 | Vogt et al. | 455/347 |
| 5,629,677 | A | 5/1997 | Staino, Jr. | |
| 5,939,981 | A | 8/1999 | Renney | |
| 5,949,516 | A | 9/1999 | McCurdy | |
| 6,769,767 | B2 * | 8/2004 | Swab et al. | 351/158 |

* cited by examiner

*Primary Examiner*—Thomas Mullen

(57) ABSTRACT

An eyeglass locator system for facilitating finding misplaced eyeglasses includes a remote transmitter and eyeglasses having a receiver, power source, amplifier, and speaker. When the eyeglasses have been misplaced, the transmitter is used to send a signal. The receiver receives the signal and activates an audible signal through the amplifier and speaker.

1 Claim, 3 Drawing Sheets

EYEGLASS LOCATOR

I. CROSS-REFERENCE TO RELATED APPLICATIONS

This application claims the benefit of U.S. Provisional Application No. 60/499,686, filed Sep. 3, 2003.

II. BACKGROUND OF THE INVENTION

The present invention relates to eyeglasses and more particularly pertains to a new eyeglass locator system for facilitating finding lost eyeglasses.

III. DESCRIPTION OF THE PRIOR ART

U.S. Pat. No. 5,949,516, issued to McCurdy, discloses an eyeglass locator system comprised of a transmitter and receiver pair for providing an audible or visible alert to indicate the presence of a lost item.

U.S. Pat. No. 5,939,981, issued to Renney, discloses a system for location of various items including eyeglasses using a sensor that is pre-applied to an object and capable of emitting an audible tone when a corresponding signal is sent from a hand-held transmitter.

U.S. Pat. No. 5,629,677, issued to Staino, Jr., discloses a locator for a pair of glasses using a chip that is affixed to an envelope holder assembly.

IV. SUMMARY OF THE INVENTION

An eyeglass locator system for facilitating finding misplaced eyeglasses includes a remote transmitter and eyeglasses having a receiver, power source, amplifier, and speaker. When the eyeglasses have been misplaced, the transmitter is used to send a signal. The receiver receives the signal and activates an audible signal through the amplifier and speaker.

There has thus been outlined, rather broadly, the more important features of an eyeglass locator system in order that the detailed description thereof that follows may be better understood, and in order that the present contribution to the art may be better appreciated. There are additional features of the eyeglass locator system that will be described hereinafter and which will form the subject matter of the claims appended hereto.

In this respect, before explaining at least one embodiment of the eyeglass locator system in detail, it is to be understood that the eyeglass locator system is not limited in its application to the details of construction and to the arrangements of the components set forth in the following description or illustrated in the drawings. The eyeglass locator system is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present eyeglass locator system. It is important, therefore, that the claims be regarded as including such equivalent constructions insofar as they do not depart from the spirit and scope of the present invention.

It is another object of the present invention to provide an eyeglass locator system which has all of the advantages of the prior art and none of the disadvantages.

It is another object of the present invention to provide an eyeglass locator system which may be easily and efficiently manufactured and marketed.

It is another object of the present invention to provide an eyeglass locator system which is of durable and reliable construction.

It is yet another object of the present invention to provide an eyeglass locator system which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
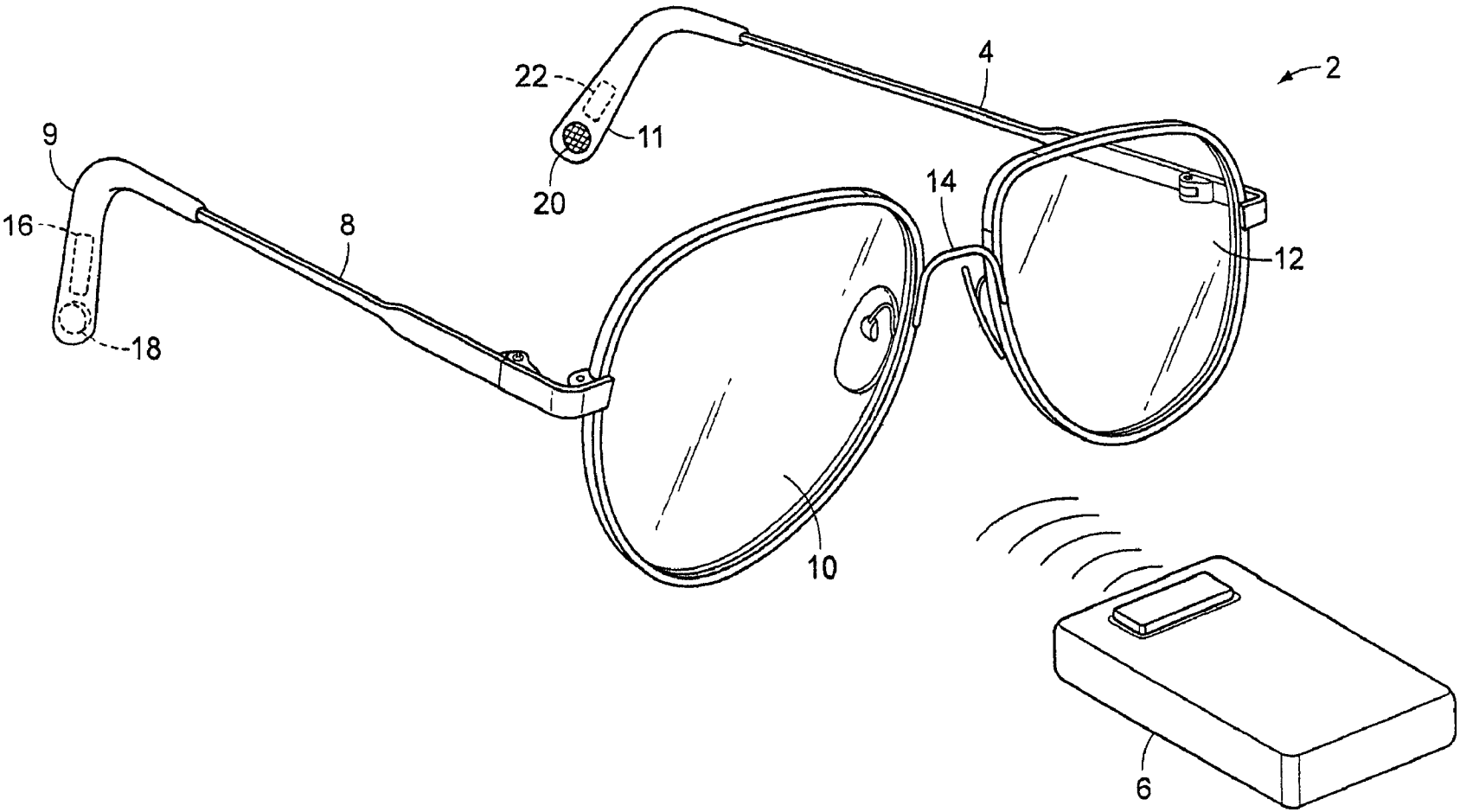
FIG. 1 is a perspective view of a new eyeglass locator system according to the present invention.
Figure 2:
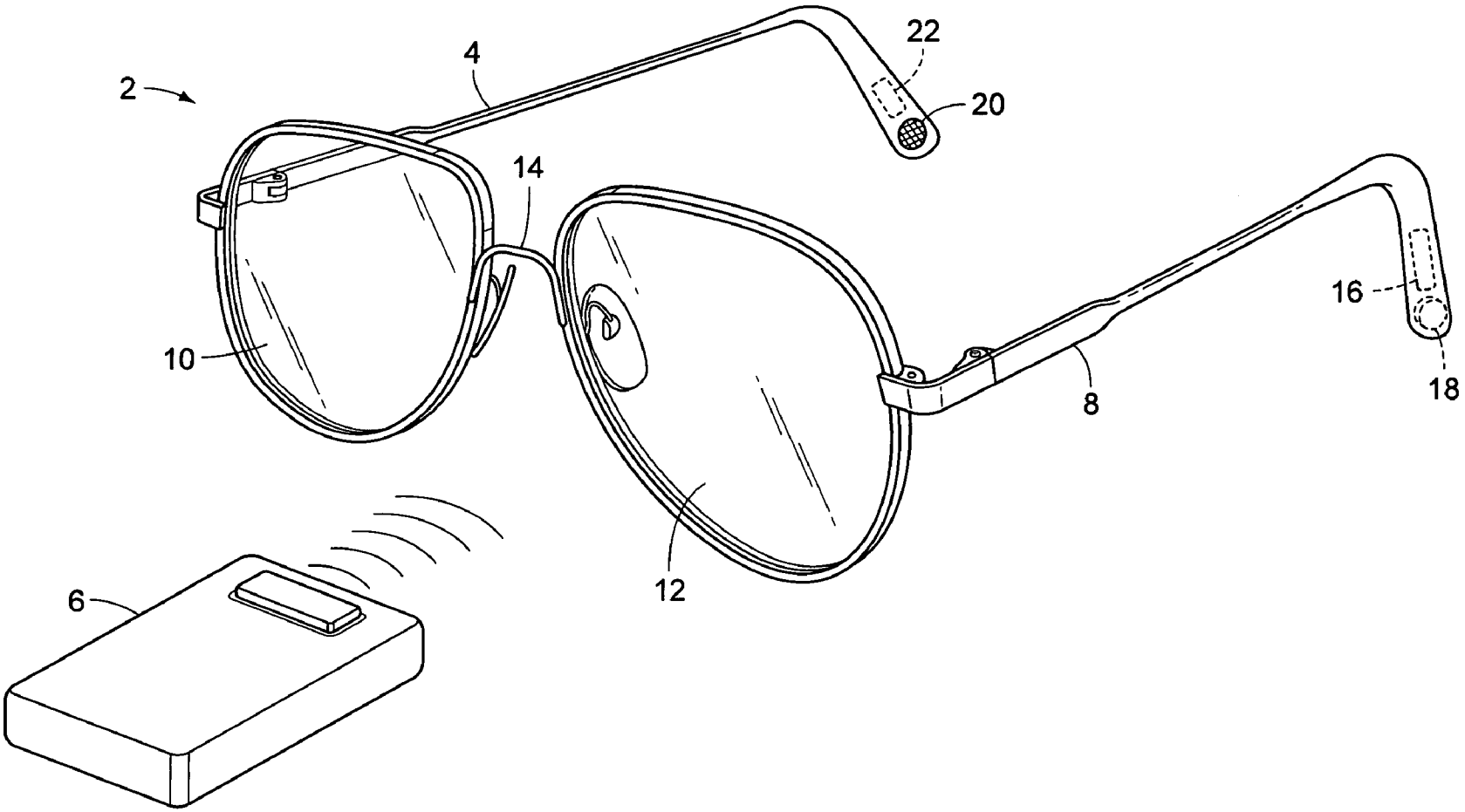
FIG. 2 is a perspective view of an alternative embodiment of the present invention.
Figure 3:
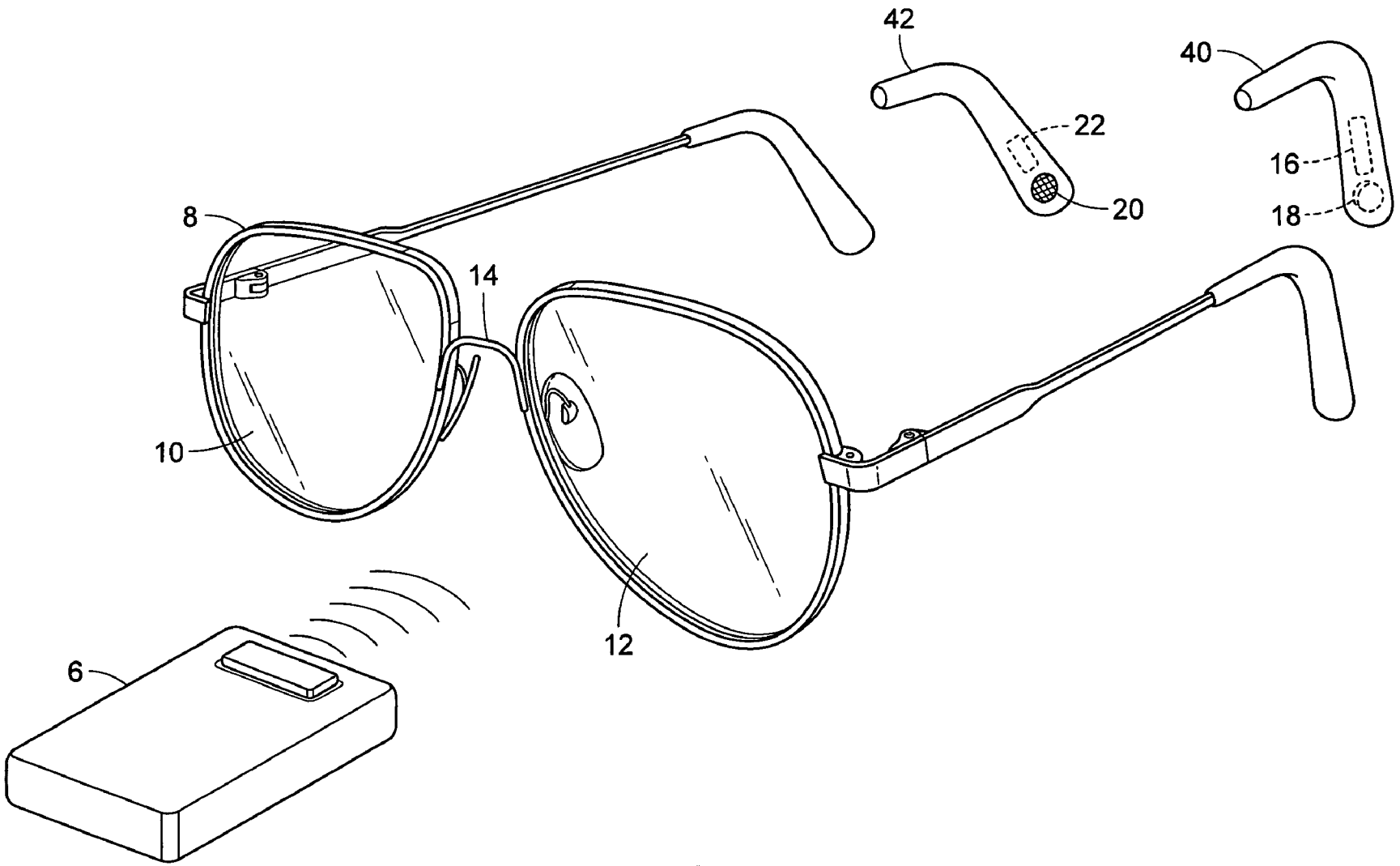
FIG. 3 is a perspective view of yet another alternative embodiment of the present invention.

With reference now to the drawings, and in particular to FIGS. 1 through 3 thereof, a new eyeglass locator system embodying the principles and concepts of the present invention will be described.

As best illustrated in FIGS. 1 through 3, the eyeglass locator system 2 generally comprises eyeglasses 4 and a remote transmitter 6. The eyeglasses 4 have a frame portion 8, lenses 10 and 12, and a bridge portion 14 extending between the lenses 10 and 12. The frame portion includes a pair of earpieces 9 and 11 comprising a first earpiece 9 and a second earpiece 11, each earpiece having two ends, a distal end and an attached end, the attached end of each earpiece being pivotally attached to the pair of eyeglasses 4.

A receiver 16 is coupled to the frame portion 8. A power source 18 is coupled to the frame portion 8 and operationally coupled to the receiver 16. A speaker 20 is coupled to the frame portion 8 and operationally coupled to the receiver 16 for producing an audible signal when the receiver 16 receives a signal transmitted from the remote transmitter 6. An amplifier 22 may be operationally coupled between the speaker 20 and the receiver 16 for amplifying the audible signal. In an embodiment of the invention the receiver 16 and power source 18 are positioned proximate a distal end of one earpiece. The speaker 20 and amplifier 22 are positioned proximate the distal end of the other earpiece.

In a second embodiment, the receiver 16 and power source 18 are integrated into the distal end of one earpiece while the speaker 20 and the amplifier 22 are embedded in the distal end of another earpiece. In this embodiment, the operational parts are preferably embedded into the earpiece such that they are substantially integral to the eyeglasses 4.

As a third embodiment, the technology in the present invention is external to the frame portion 8 and embedded in separate plastic casing units 40 and 42 that can be installed and fitted over the distal ends of each ear piece of a pre-manufactured eyeglass stem. A heat source is used to melt and mold the plastic of the casing units 40 and 42 so that they conform to the styling of the eyeglass frames selected by the customer.

In use, a person who has misplaced their eyeglasses 4 would send a signal using the remote transmitter 6. The receiver 16 receives the transmitted signal and activates an audible signal through the amplifier 22 and speaker 20. The person then listens for the audible signal to assist in locating the misplaced eyeglasses 4.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. An eyeglass locator system comprising:

a pair of eyeglasses comprising a frame portion, the frame portion including a first frame member and a second frame member, each frame member having a distal end and an attached end, the attached end of each frame member being pivotally attached to the pair of eyeglasses, the pair of eyeglasses further comprising a pair of lenses integrated into the frame portion, the pair of lenses comprising a first lens and a second lens, the pair of eyeglasses further comprising a bridge portion extending in between the two lenses, the pair of eyeglasses further comprising a pair of nosepads comprising a left nosepad and a right nosepad, a first casing unit releasably secured to the distal end of the first frame member, a second casing unit releasably secured to the distal end of the second frame member, a receiver coupled to the first casing unit, a power source coupled to the first casing unit, the power source also operationally coupled to the receiver, a speaker coupled to the second casing unit, the speaker also operationally coupled to the receiver, an amplifier connected to the second casing unit, the amplifier operationally coupled to both the receiver and the speaker, a transmitter, wherein the transmitter is capable of emitting a signal, further wherein the receiver receives the signal and activates an audible signal through the amplifier and speaker, further wherein an individual can locate the eyeglasses by listening for the audible signal.

* * * * *